US009271892B1

(12) United States Patent
Bement

(10) Patent No.: US 9,271,892 B1
(45) Date of Patent: Mar. 1, 2016

(54) WALKER LEG REST

(71) Applicant: Dickie R. Bement, Paxton, IL (US)

(72) Inventor: Dickie R. Bement, Paxton, IL (US)

( * ) Notice: Subject to any disclaimer, the term of this patent is extended or adjusted under 35 U.S.C. 154(b) by 0 days.

(21) Appl. No.: 14/727,942

(22) Filed: Jun. 2, 2015

Related U.S. Application Data

(60) Provisional application No. 62/024,579, filed on Jul. 15, 2014.

(51) Int. Cl.
*A61H 3/00* (2006.01)
*A45B 3/00* (2006.01)

(52) U.S. Cl.
CPC .. *A61H 3/00* (2013.01); *A45B 3/00* (2013.01); *A61H 2003/005* (2013.01)

(58) Field of Classification Search
CPC ..... A61H 3/00; A61H 2201/0161; A61H 2201/1633; A61H 2003/005; A45B 1/00; A45B 1/04; A45B 3/00
USPC ..... 135/65–67, 74; 482/66–68
See application file for complete search history.

(56) References Cited

U.S. PATENT DOCUMENTS

| | | | | |
|---|---|---|---|---|
| 2,602,488 | A * | 7/1952 | Conning | B60N 2/4673 248/118 |
| 2,778,370 | A * | 1/1957 | Chamblee | A61H 3/02 135/68 |
| 3,596,668 | A | 8/1971 | Tosto | |
| 3,881,644 | A * | 5/1975 | Demaline | A47D 13/025 224/153 |
| 4,571,754 | A * | 2/1986 | England | A61G 9/00 248/154 |
| 4,722,356 | A | 2/1988 | Rehder | |
| 5,291,909 | A | 3/1994 | Skorman et al. | |
| 5,524,657 | A | 6/1996 | Jih | |
| D419,288 | S * | 1/2000 | Hartfield | D3/7 |
| 6,279,591 | B1 * | 8/2001 | Obitts | A61H 3/00 135/66 |
| D507,212 | S * | 7/2005 | Tomlinson | D12/130 |
| 2003/0098051 | A1 * | 5/2003 | Fismer | A61H 3/02 135/66 |
| 2007/0251560 | A1 * | 11/2007 | Moore | A61H 3/02 135/66 |
| 2010/0200030 | A1 * | 8/2010 | Yefimov | A61H 3/02 135/66 |
| 2013/0075997 | A1 * | 3/2013 | Mailahn | A61H 3/04 280/263 |

* cited by examiner

*Primary Examiner* — Winnie Yip
(74) *Attorney, Agent, or Firm* — Philip L. Bateman

(57) ABSTRACT

A leg rest for a walker contains: (a) a vertical post having a top; (b) a bifurcated semi-cylindrical hook having a horizontal axis attached to the top of the vertical post, the hook adapted for placement over a handle of a walker; and (c) a leg rest platform attached to one or more of the attachment receptacles of the vertical post.

12 Claims, 2 Drawing Sheets

WALKER LEG REST

CROSS-REFERENCE TO RELATED APPLICATION

This application claims the benefit of U.S. Provisional Application Ser. No. 62/024,579, Jul. 15, 2014.

FIELD OF THE INVENTION

This invention relates to walkers. More particularly, this invention relates to leg rests for walkers.

BACKGROUND OF THE INVENTION

A crutch is a mobility device commonly used by persons who cannot use one leg due to injury or disability. The most common type is the underarm crutch, also known as the axilla crutch. An underarm crutch contains a pad that is placed under the armpit. Crutches are undesirable for many reasons. They are uncomfortable, they require both hands, and they require the user to lift a leg off the ground.

A walkers is another type of mobility device. Walkers are commonly used by persons who cannot support all their weight or who cannot balance. Walkers are three-sided frames (front and two sides) with horizontal handles on the sides and with four main legs. The bottoms of the legs contain wheels, balls, or pads to facilitate movement. Walkers are not suitable for persons who can use only one leg because considerable upper body strength is required to support the body while suspending one leg.

Leg rests for walkers have been disclosed. Walker leg rests allow the user to better support the body weight by bending one leg and resting the knee on the leg rest. The body weight is thus supported by both legs (although only one foot is on the ground) and by both arms. It is believed that walker leg rests have not achieved commercial success for many reasons. Some fit only the left or the right leg, some fit only one type of walker, some are cumbersome and difficult to attach to the walker, and some require many parts and fasteners that are easily lost when not in use.

Tosto, U.S. Pat. No. 3,596,668, Aug. 3, 1971, discloses a walker leg rest that fits only the left or right leg and fits only walkers having a three-sided horizontal bar at the desired height. Rehder, U.S. Pat. No. 4,722,356, Feb. 2, 1988, discloses a walker leg rest that is interchangeable for the left or right leg, but fits only walkers having a specific width and having an adequate space in the front of the frame. Skorman et al., U.S. Pat. No. 5,291,909, Mar. 8, 1994, discloses a walker leg rest that fits only the left or right leg. It attaches to the walker with cumbersome brackets and may fit only walkers having a specific depth. Jih, U.S. Pat. No. 5,524,657, Jun. 11, 1996, discloses a walker leg rest that is interchangeable for the left or right leg. It attaches to the walker with cumbersome brackets and fits only walkers having two horizontal bars on the sides below the handles with an adequate space between them.

Accordingly, there is a demand for a walker leg rest that is interchangeable for the left or right leg, is easily and quickly attached and removed, and universally fits all walkers.

SUMMARY OF THE INVENTION

The general object of this invention is to provide an improved walker leg rest. More particular objects are to provide a walker leg rest that is interchangeable for the left or right leg, is easily and quickly attached and removed, and universally fits all walkers.

I have invented an improved walker leg rest. The leg rest comprises: (a) a vertical post having a top; (b) a bifurcated semi-cylindrical hook having a horizontal axis attached to the top of the vertical post, the hook adapted for placement over a handle of a walker; and (c) a leg rest platform attached to one or more of the attachment receptacles of the vertical post.

The walker leg rest of this invention is interchangeable for the left or right leg, is easily and quickly attached and removed, and universally fits all walkers.

DETAILED DESCRIPTION OF THE INVENTION

Figure 2:
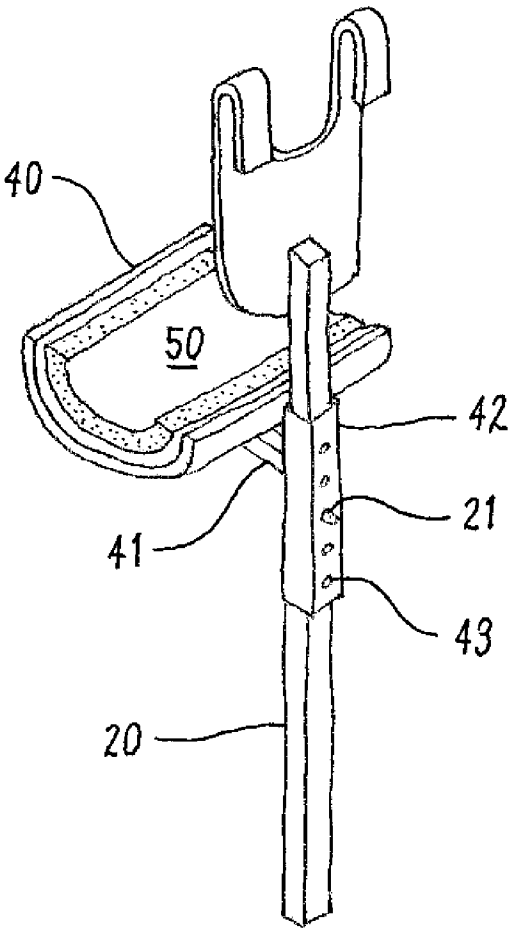
FIG. 2 is a rear perspective view thereof.
Figure 1:
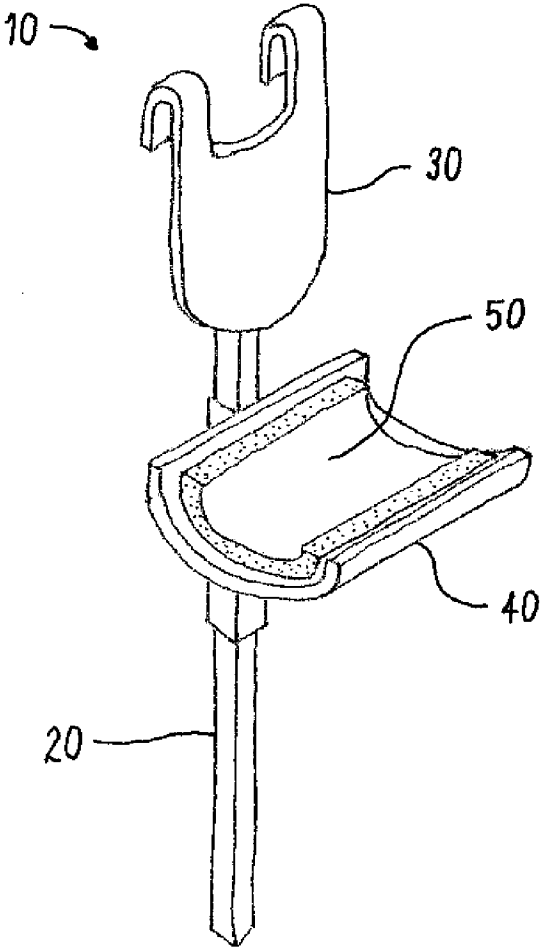
FIG. 1 is a front perspective view of a preferred embodiment of the walker leg rest of this invention.

This invention is best understood by reference to the drawings. Referring first to FIGS. 1 and 2, a preferred embodiment of the walker leg rest 10 of this invention comprises a vertical post 20, a hook 30, a platform 40, and a pad 50. The components are discussed in more detail below.

The vertical post 20 provides multiple functions. It connects the hook and platform. It rests against one or more of the horizontal bars on the sides of the walker to maintain its vertical orientation when in use. And, in the preferred embodiment, it provides a means for adjusting the height of the platform. The vertical post is preferably hollow to save weight and cost. The vertical post is preferably square in cross-section to provide a flat surface for contact with the horizontal bars and to provide a flat surface for attachment of the hook and the platform. The post is made of a durable material such as metal or molded thermoplastic. Aluminum and steel tend to be more durable, but thermoplastics are lighter in weight and less expensive. The post is preferably made of a twenty-four inch section of one inch square aluminum tubing.

The hook 30 is attached to the top of the vertical post and fits over the handrail on either side of the walker when in use. The hook is attached to the vertical post by welding, nuts and bolts, or other suitable attachment means. The bifurcation of the hook straddles the grip, leaving the grip available for use. The bifurcation also provides additional stability. The distance between the bifurcated hook portions is generally about four to six inches to accommodate the grip. The hook portions conform to the shape of the handrails of the walker. The hook portions generally form semi-cylinders having a radius of about three-fourths to one and one-half inch to fit snugly on the cylindrical handrails of walkers. The hook is made of a durable material such as metal or molded thermoplastic. Aluminum and steel tend to be more durable, but thermoplastics are lighter in weight and less expensive. The hook is preferably made of aluminum because of its durability and light weight.

The platform 40 is attached to the vertical post and provides the support for one of the user's legs. The size and shape of the platform are, to some extent, matters of choice. The platform is preferably semi-cylindrical with a radius of about eight to sixteen inches to conform to the shape of the knee and upper part of the lower leg, but flat platforms are also suitable. The length of the platform is generally about six to twelve inches and preferably about seven to nine inches. The platform is made of a durable material such as metal or molded thermoplastic. Aluminum and steel tend to be more durable, but thermoplastics are lighter in weight, less expensive, and moldable into shapes that closely conform to the leg. The platform is preferably made of aluminum because of its durability and light weight. The platform preferably includes a support member 41 for additional structural strength. If the platform is made of metal, a cover for the edges is preferred to eliminate the danger of injury from sharp edges.

The leg rest preferably includes a pad 50 on the upper surface of the platform to provide additional comfort. The pad is especially preferred if the platform is made of a metal. Pads are well known in the art and generally comprise synthetic foams made of polyurethane or the like. If desired, the foam is covered with a protective layer of material such as polyvinyl chloride, canvas, fleece, or the like.

The position of the platform on the vertical post is preferably adjustable. A variety of adjustment mechanisms are suitable. For example, one mechanism includes vertically spaced apart holes in one side of the platform and in the vertical post. The platform is positioned as desired and bolts or other fasteners are passed through the holes. This mechanism is easy and secure, but changing the position of the platform is time consuming, generally requires tools, and there is always the risk of losing parts. A preferred mechanism is shown in FIGS. 1 and 2. The vertical post contains a spring loaded button 21 and the platform is attached to a telescoping sleeve 42 with a plurality of vertically spaced apart holes 43. The position of the platform is adjusted by depressing the button, moving the platform and sleeve to the desired position, and then releasing the button to engage the desired hole. This mechanism is fast, requires no tools, and there are no parts to lose.

Figure 4:
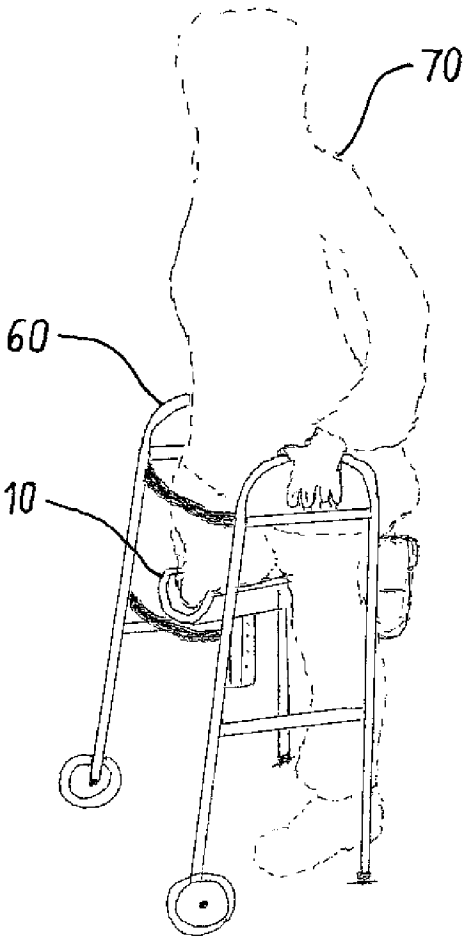
FIG. 4 is a perspective view of a person using the walker leg rest.
Figure 3:
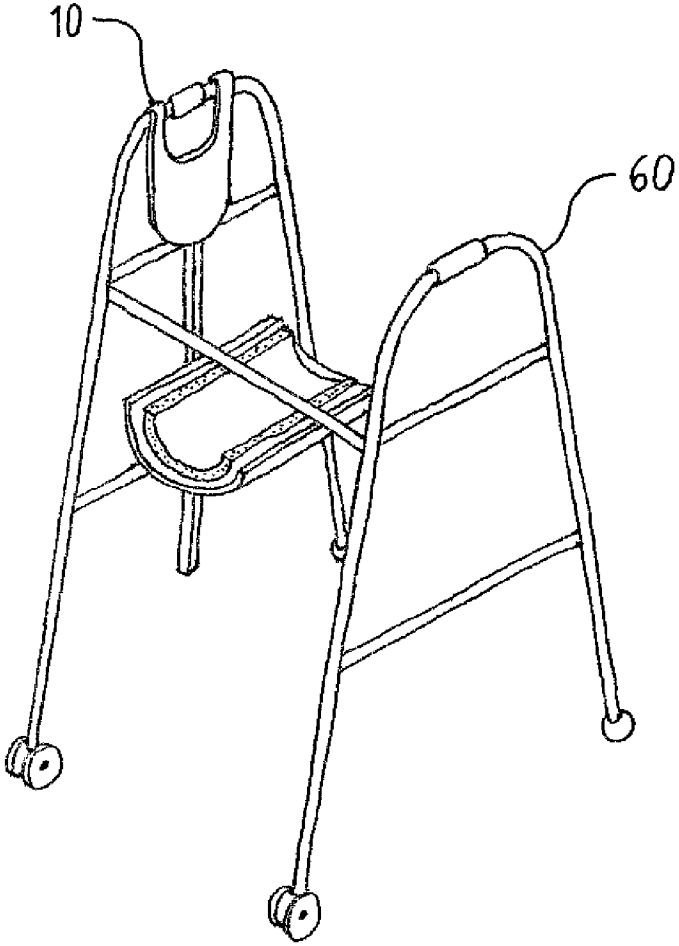
FIG. 3 is a perspective view of the walker leg rest on a prior art walker.

The use of the walker leg rest can now be considered. Referring to FIG. 3, the leg rest is simply placed over the handle of a walker 60 on the desired side. If necessary, the platform is adjusted in height to best fit the user. The leg rest is stable in position and additional stability is provided if the grip of the handle is sufficiently large to prevent any lateral movement of the hook. Referring now to FIG. 4, a user 70 bends one leg, places it onto the platform, and then uses the walker in the conventional manner.

The walker leg rest of this invention is interchangeable for the left or right leg, is easily and quickly attached and removed without the need for any other parts or fasteners, and universally fits all walkers. It is easily produced, durable, light in weight, and compact for storage. Elevating an injured leg provides better blood circulation and speeds the healing process.

I claim:

1. A leg rest for a walker, the leg rest consisting essentially of:

(a) a vertical post having a top, an inner side, an unobstructed outer side, and a fixed height;

(b) a single bifurcated semi-cylindrical hook with no moving parts having spaced apart bifurcations formed along a horizontal axis attached to the top of the vertical post, the bifurcations being hooks turned downward and toward the outer side of the post and sufficiently separated for placement straddling a handle of a walker; and (c) a leg rest platform attached to the inner side of the vertical post.

2. The leg rest of claim 1 wherein the leg rest platform is semi-cylindrical along an axis parallel to the longitudinal axis of the hook.

3. The leg rest of claim 1 additionally comprising a cushioned pad attached to the upper surface of the platform.

4. The leg rest of claim 1 additionally comprising a means for varying the attachment position of the leg rest platform on the vertical post.

5. The leg rest of claim 1 wherein the leg rest platform is attached to a vertical sleeve that telescopes over the vertical post.

6. The leg rest of claim 5 wherein the vertical post contains an outwardly biased post and wherein the vertical sleeve contains a plurality of vertically spaced apart bores that engage the post to set the position of the leg rest platform on the vertical post.

7. An assembly of a walker and a removable leg rest, the assembly comprising:

(a) a walker comprising a frame with a front side, a left side with an upper horizontal bar having a handle, a right side with an upper horizontal bar having a handle, the sides defining an interior adapted for a person; and (b) a removable leg rest hanging in the interior from the upper horizontal bar of either the left side or right side of the walker, the leg rest consisting of: (i) a vertical post having a top, an inner side, an unobstructed outer side, and a fixed height; (ii) a single bifurcated semi-cylindrical hook having spaced apart bifurcations formed along a horizontal axis attached to the top of the vertical post, the bifurcations being hooks turned downward and toward the outer side of the post and sufficiently separated that they straddle the handle of the walker; and (iii) a leg rest platform attached to the inner side of the vertical post.

8. The assembly of claim 7 wherein the leg rest platform is semi-cylindrical along an axis parallel to the longitudinal axis of the hook.

9. The assembly of claim 7 additionally comprising a cushioned pad attached to the upper surface of the platform.

10. The assembly of claim 7 additionally comprising a means for varying the attachment position of the leg rest platform on the vertical post.

11. The assembly of claim 7 wherein the leg rest platform is attached to a vertical sleeve that telescopes over the vertical post.

12. The assembly of claim 11 wherein the vertical post contains an outwardly biased post and wherein the vertical sleeve contains a plurality of vertically spaced apart bores that engage the post to set the position of the leg rest platform on the vertical post.

* * * * *